US007147173B2

(12) United States Patent
Patrick

(10) Patent No.: US 7,147,173 B2
(45) Date of Patent: Dec. 12, 2006

(54) NITROUS FUEL NOZZLE AND METHOD OF USE

(75) Inventor: Matthew R. Patrick, Cordova, TN (US)

(73) Assignee: Competition Cams, Inc., Memphis, TN (US)

( * ) Notice: Subject to any disclaimer, the term of this patent is extended or adjusted under 35 U.S.C. 154(b) by 248 days.

(21) Appl. No.: 10/735,636

(22) Filed: Dec. 16, 2003

(65) Prior Publication Data

US 2004/0173695 A1 Sep. 9, 2004

Related U.S. Application Data

(60) Provisional application No. 60/433,804, filed on Dec. 17, 2002.

(51) Int. Cl.

| | |
|---|---|
| ***B05B 7/08*** | (2006.01) |
| ***B05B 7/30*** | (2006.01) |
| ***F23D 11/36*** | (2006.01) |
| ***F02M 23/00*** | (2006.01) |
| ***F02M 29/00*** | (2006.01) |

(52) U.S. Cl. ..... 239/426; 239/8; 239/418; 239/434; 239/318; 239/543; 123/585; 123/590

(58) Field of Classification Search ..... 239/426, 239/8, 418, 434, 318, 543, 5, 11, 290, 294, 239/295, 300, 310, 398, 420, 433, 533.2, 239/544; 123/585, 590, 1 A, 470, 531
See application file for complete search history.

(56) References Cited

U.S. PATENT DOCUMENTS 1,564,343 A * 12/1925 Gibson ..... 239/139
1,879,363 A * 9/1932 Loepsinger ..... 239/118
4,079,893 A * 3/1978 Bass ..... 239/346
4,827,888 A * 5/1989 Vaznaian et al. ..... 123/531
5,190,220 A * 3/1993 Bolton ..... 239/305
5,699,776 A * 12/1997 Wood et al. ..... 123/531
5,890,476 A * 4/1999 Grant ..... 123/585
6,116,225 A * 9/2000 Thomas et al. ..... 123/590
6,520,165 B1 * 2/2003 Steele ..... 123/590

* cited by examiner

*Primary Examiner*—Dinh Q. Nguyen
*Assistant Examiner*—Darren Gorman
(74) *Attorney, Agent, or Firm*—Wilburn L. Chesser; Arent Fox PLLC

(57) ABSTRACT

A nozzle for mixing and delivering two or more components and method of use thereof. One variation provides a nozzle that injects a first component, such as fuel, into a flow plume for a second component, such as nitrous oxide, for use with combustion engines. The nozzle receives two or more separate flows of components (e.g., gases and/or liquids), one of which is pressurized so as to be outputtable from the nozzle as a plume. The plume is directed so as to encompass an output extension for the other component near the plume edge, thereby enhancing mixture of the components. In addition, the plume produces a low pressure draw of the second component from the output extension, the low pressure draw varying with plume velocity, in turn varying with delivery pressure of the first component. The plume flow of the second component also atomizes the first component, further enhancing mixing.

29 Claims, 8 Drawing Sheets

FIG. 1
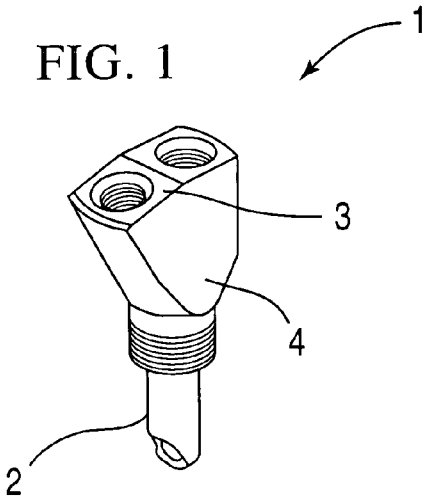
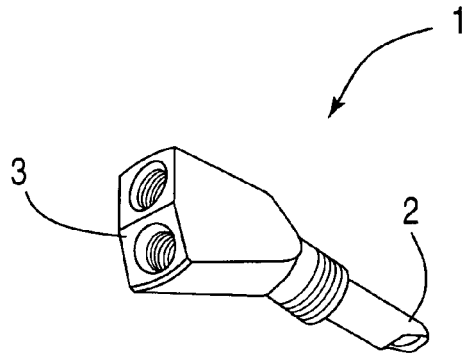
FIG. 2
FIG. 3
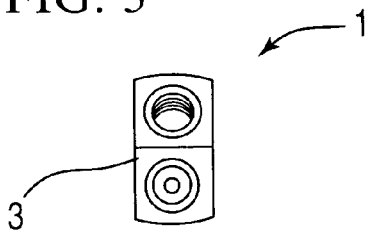
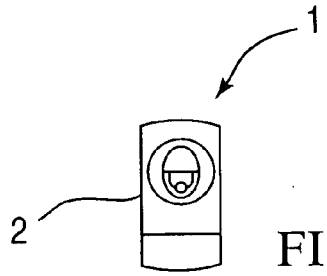
FIG. 4

FIG. 12
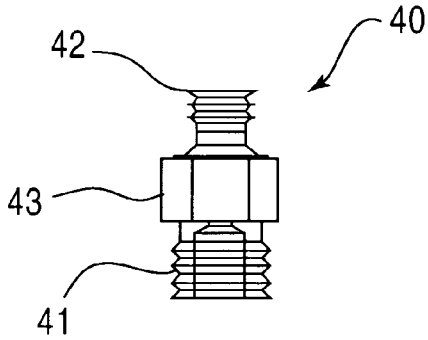
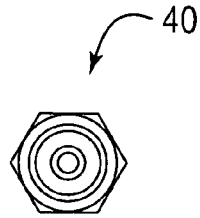
FIG. 13
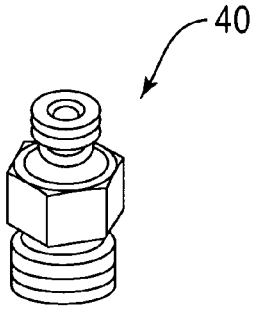
FIG. 14
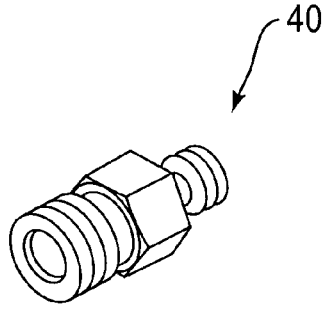
FIG. 15
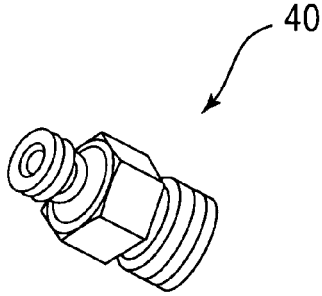
FIG. 16

NITROUS FUEL NOZZLE AND METHOD OF USE

This application claims priority to applicants' copending U.S. Provisional Patent Application Ser. No. 60/433,804 titled "NITROUS FUEL NOZZLE AND METHOD OF USE" filed Dec. 17, 2002. The entirety of that provisional patent application is incorporated herein by reference.

BACKGROUND OF THE INVENTION

1. Field of the Invention

The present invention relates to the field of nozzles for mixing and delivering two components, and in particular a nozzle designed for delivering a fuel flow into an oxygen enhancer flow plume for enhanced fuel delivery and performance for internal combustion engines.

2. Background of the Technology

There remains an unmet need for nozzles and other components to improve mixing and delivery of separate streams or flows of components (e.g., gases and/or liquids), such as fuel and nitrous oxide.

SUMMARY OF THE INVENTION

The present invention relates to mixture and delivery of two components via a nozzle. In particular, the nozzle of the present invention is designed to receive two separate flows of components (e.g., gases and/or liquids), at least one of which is pressurized so as to be outputtable from the nozzle as a plume. In one embodiment, the plume is produced and directed so as to encompass an output extension (e.g., tube end) for the second component near the plume edge, thereby enhancing mixture of the two components. In addition, the plume is directed relative to the output extension, such that the velocity of the flow of the plume over the output extension produces a low pressure or vacuum draw of the second component from the output extension, the low pressure draw varying with variations in plume velocity, which in turn vary, for example, with delivery pressure of the first component. As a result, the nozzle provides self-regulation of second component draw with first component pressure variation, and the second component plume flow further enhances mixing with and atomizing of the first component.

One embodiment of the present invention provides an injector nozzle (also referred to interchangeably herein as an "injection nozzle" and a "fuel nozzle") having a first component transfer tube (e.g., fuel tube) that injects the first component (e.g., fuel, such as gasoline or diesel) directly into an outer edge of a plume containing a second component, such as an oxygen enhancer (e.g., nitrous oxide), as the first component exits the nozzle tip, with the combined components then being deliverable, such as via a communicating coupling (e.g., line or hose) to an internal combustion engine. The injector nozzle is thus connected in series between the sources of the first and second components and the internal combustion engine (e.g., via connection of the nozzle output to the throttle body of a fuel injector, coupled in turn to the internal combustion engine).

In operation in accordance with one embodiment, in which the second component is pressurized, the high-speed flow of the second component shears the first component away from the tube, atomizing the first component to a much finer degree than nozzle designs of the prior art, which have previously generally provided, for example, only a stream of fuel delivered to a location outside of such plumes. This high level of atomization ensures improved distribution among the two components, such as from cylinder to cylinder in multicylinder internal combustion engine applications, which is especially useful with the higher horsepower settings that such systems may be capable of when used with an oxygen enhancer, such as nitrous oxide.

In an embodiment of the present invention, the first component transfer tube also allows for a self-adjusting characteristic to be produced in the nozzle. This embodiment takes advantage of a low pressure zone that is created as the flow of pressurized oxygen enhancer forms a plume encompassing the tube opening. As pressure varies in the second component enhancer flow to the nozzle (e.g., due to nitrous oxide bottle temperature changes or varying bottle pressure as the nitrous oxide is expelled), the second component velocity and mass flow upon exiting the nozzle also varies. This variation in velocity and mass flow of the second component causes the first component, delivered via the first component transfer tube appropriately placed within the flow plume, to be exposed to a variable level of low pressure, which helps to "pull" a varying amount of the first component from the first component transfer tube, and, hence, deliver correspondingly varying amounts of the first component with the second component, as pressure fluctuations dictate. This feature ensures much more consistent, safe, and powerful use of the system when used with a second component delivered from a variable source (e.g., nitrous oxygen delivered from a bottle at varying pressure as the bottle is expended).

In one embodiment of the present invention, two components are communicated to the injector nozzle via fittings that couple to delivery couplings (e.g., lines or hoses) for the sources of the components. In one embodiment, the nozzle includes an external thread or other feature for coupling the nozzle to a line or hose.

Additional advantages and novel features of the invention will be set forth in part in the description that follows, and in part will become more apparent to those skilled in the art upon examination of the following or upon learning by practice of the invention.

BRIEF DESCRIPTION OF THE FIGURES

In the drawings:

FIG. 1 is a first perspective view of an injector nozzle having a discharge end and an intake end, in accordance with an embodiment of the present invention;

FIG. 2 shows a second perspective view of the injector nozzle of FIG. 1;

FIG. 3 presents an end view of the injector nozzle of FIG. 1, from the intake end;

FIG. 4 shows an end view of the injector nozzle of FIG. 1, from the discharge end;

FIG. 12 is a side view of an example fitting for use with an injector nozzle, in accordance with an embodiment of the present invention;

FIG. 13 shows an end view of the example fitting of FIG. 12;

FIGS. 14–16 present perspective views of the example fitting of FIG. 12;

DETAILED DESCRIPTION

Figure 5:
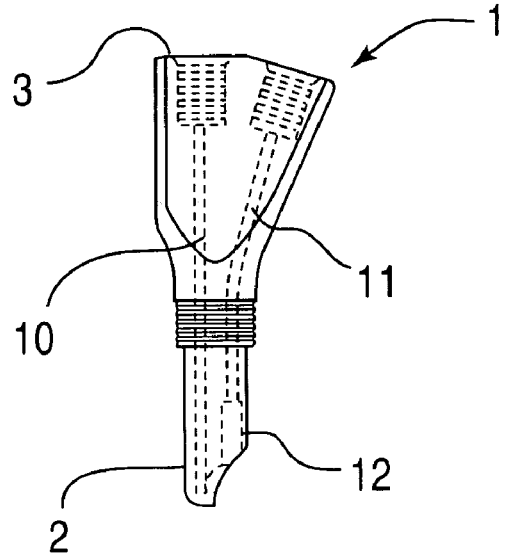
FIG. 5 is a cutaway view of the injector nozzle of FIG. 1, showing an interior oxygen enhancer passage, an interior fuel passage, and a fuel tube receiving opening.

The present invention provides a nozzle for mixing and delivering two or more components, as well as a method for use thereof. One embodiment of the present invention provides a nozzle designed for injecting a first component, such as a fuel flow, into a flow plume for a second component, such as nitrous oxide, for such applications as enhanced fuel delivery and performance for internal combustion engines. The nozzle of this embodiment is designed to receive two or more separate flows of components (e.g., gases and/or liquids), at least one of which is pressurized so as to be outputtable from the nozzle as a plume. The plume is produced and directed so as to encompass an output extension for delivering the second component near the plume edge, thereby enhancing mixture of the two components. In addition, the plume is directed relative to the output extension, such that the velocity of the flow of the plume over the output extension produces a low pressure or vacuum draw of the second component from the output extension, the low pressure draw varying with variations in plume pressure, which in turn varies, for example, with delivery pressure of the first component. As a result, the nozzle provides self-regulation of second component draw with first component pressure variation.

A particular exemplary application of the nozzle of the present invention for fuel delivery with an oxygen enhancer, such as nitrous oxide, for use in a vehicle having an internal combustion engine will now be described in greater detail. The particular application is not intended to be limiting, but to be merely illustrative of one particular application of the present invention.

The present invention, referred to in one embodiment as a "nitrous system injector nozzle," includes features that enhance fuel delivery and combustion by atomizing the fuel via a fuel transfer tube (also referred to interchangeably herein as a "transfer tube" and as a "fuel tube") and by providing a device design that includes self-adjusting properties for affecting fuel flow, such that variations in the pressure of an oxygen enhancer used therewith, such as nitrous oxide, produces corresponding variations in a vacuum affecting draw of fuel. This fuel and oxygen enhancer delivery occurs in applications known in the art, such as for delivery of fuel (e.g., gasoline, diesel fuel) with nitrous oxide provided via a bottle for use in internal combustion engines for use in vehicles or other applications. As is known in the art, such bottle provided nitrous oxide is typically delivered via a communicating coupling, such as a line or hose, and fuel is likewise delivered via a communicating coupling to a fuel source having a flow delivery device (e.g., gas tank and fuel pump).

One embodiment of the present invention includes an injector nozzle (also referred to interchangeably herein as an "injection nozzle" and a "fuel nozzle") having a fuel transfer tube that injects fuel directly into an outer edge of an oxygen enhancer plume as the fuel exits the nozzle tip, with the combined oxygen enhancer and fuel then being delivered, such as via a communicating coupling (e.g., line or hose) to the internal combustion engine. The injector nozzle is thus connected in series between the sources of oxygen enhancer and fuel, and the internal combustion engine (e.g., via coupling to the throttle body of a fuel injector coupled in turn to the internal combustion engine, as is known in the art).

In operation, the high-speed flow of oxygen enhancer shears the fuel away from the tube, atomizing the fuel to a much finer degree than nozzle designs of the prior art, which generally simply provide a solid stream of fuel delivered to a location outside of such plumes. The high level of fuel atomization of the present invention thus ensures improved fuel distribution, such as from cylinder to cylinder in multicylinder internal combustion engine applications, which is especially useful with the higher horsepower settings that such system may be capable of when used with an oxygen enhancer, such as nitrous oxide.

In an embodiment of the present invention, the fuel transfer tube also allows for a self-adjusting "fuel trim" characteristic to be produced in the nozzle. This embodiment takes advantage of a low pressure zone in the oxygen enhancer plume that encompasses the tube opening. As velocity varies in the oxygen enhancer flow (e.g., due to nitrous oxide bottle temperature changes or varying bottle pressure as the nitrous oxide is expelled), the oxygen enhancer velocity and mass flow upon exiting the nitrous injector nozzle also varies. This variation in velocity and mass flow of the oxygen enhancer results in fuel, appropriately placed within the flow plume via the fuel transfer tube, to be exposed to a variable level of pressure draw. This variable pressure draw helps to "pull" a variable amount of fuel from the fuel transfer tube, and, hence, deliver a correspondingly varying amount of fuel with the oxygen enhancer, as pressure fluctuations in the oxygen enhancer dictate. This feature ensures much more consistent, safe, and powerful use of the oxygen enhancer system.

In an embodiment of the present invention, the injector nozzle includes interior passages for communicating separately received flows of oxygen enhancer, such as nitrous oxide, and fuel, to discharge locations, where an oxygen enhancer plume is produced that encompasses an end of an extending fuel transfer tube. In one embodiment, the oxygen enhancer and fuel are communicated to the injector nozzle via fittings. In one embodiment, these fittings are designed for coupling to fuel and oxygen enhancer couplings (e.g., lines or hoses).

References will now be made in detail to embodiments of the present invention, examples of which are illustrated in the accompanying drawings.

FIG. 1 is a first perspective view of an injector nozzle 1 having a discharge end 2 and an intake end 3, the discharge end 2 being attached to a first end of an injector nozzle body 4, in accordance with an embodiment of the present invention.

FIG. 2 shows a second perspective view of the injector nozzle 1 of FIG. 1.

FIG. 3 presents an end view of the injector nozzle 1 of FIG. 1, from the intake end 3. FIG. 4 shows an end view of the injection nozzle 1 of FIG. 1, from the discharge end 2.

Figure 6:
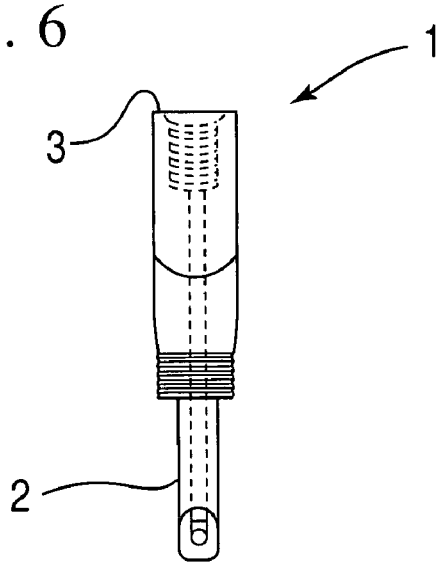
FIG. 6 is a side cutaway view of the injector nozzle of FIG. 1.

FIG. 5 is a cutaway view of the injector nozzle 1 of FIG. 1, showing an interior oxygen enhancer passage 10, an interior fuel passage 11, and a fuel tube receiving opening 12, with example specifications presented. FIG. 6 is a side cutaway view of the injector nozzle of FIG. 1, with example specifications shown.

Figure 7:
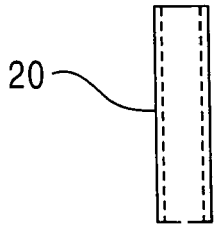
FIG. 7 is a side view of a fuel tube, in accordance with an embodiment of the present invention.
Figure 8:
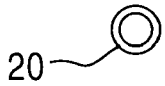
FIG. 8 presents an end view of the fuel tube of FIG. 7.
Figure 9:
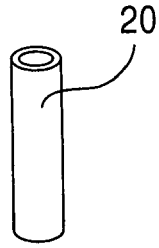
FIG. 9 shows a perspective view of the fuel tube of FIG. 7.

FIG. 7 is a side view of a fuel tube 20. FIG. 8 presents an end view of the fuel tube 20 of FIG. 7. FIG. 9 shows a perspective view of the fuel tube 20 of FIG. 7.

Figure 10:
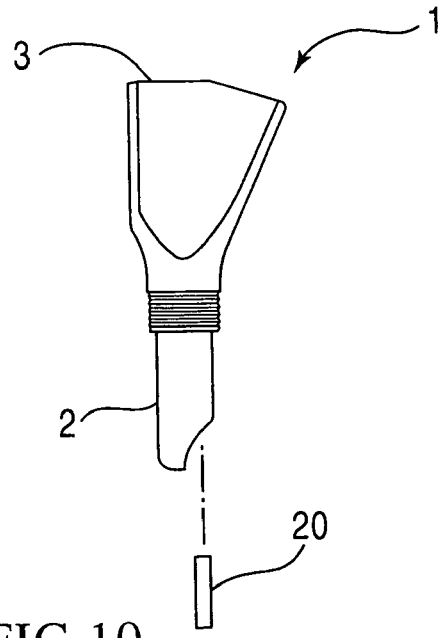
FIG. 10 presents a side view of an injector nozzle and fuel tube to be inserted into the injector nozzle, in accordance with an embodiment of the present invention.
Figure 11:
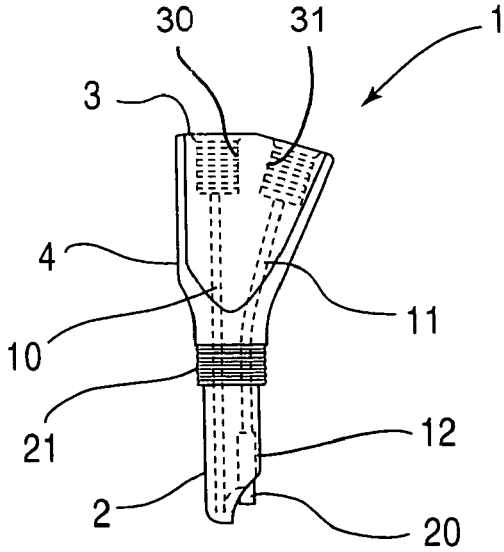
FIG. 11 shows a cutaway view of the injector nozzle of FIG. 10.

FIG. 10 presents a side view of an injector nozzle 1 and fuel tube 20 to be inserted into the injector nozzle 1. FIG. 11 shows a cutaway view of the injector nozzle 1 of FIG. 10, with the fuel tube 20 fixably inserted into the fuel tube receiving opening 12, such as by pressure fitting of the fuel tube 20 in the fuel tube receiving opening 12, and such that the opening of the fuel tube 20 communicates with the fuel tube receiving opening 12. The fuel tube 20 could also be fixably held in the fuel tube receiving opening 12 by other methods, devices, and features known in the art, such as by use of an adhesive, threads, or a fixed or otherwise attached extension with a central opening could be used in lieu of the fuel tube 20. Also shown in FIG. 11 are threaded openings 30, 31 for threadably receiving fittings for transmitting oxygen enhancer and fuel, respectively. The threadings are shown for illustrative purposes only. The injection nozzle 1 may also receive fittings by other methods, devices, and features known in the art, such as by compression fitting.

Also shown in FIG. 11 is a threaded outer portion 21 of the housing 4 for use, for example, in attaching the nozzle 1 to a delivery coupling (e.g., threaded coupling attached to a line or hose for connection to a throttle body).

Figure 17:
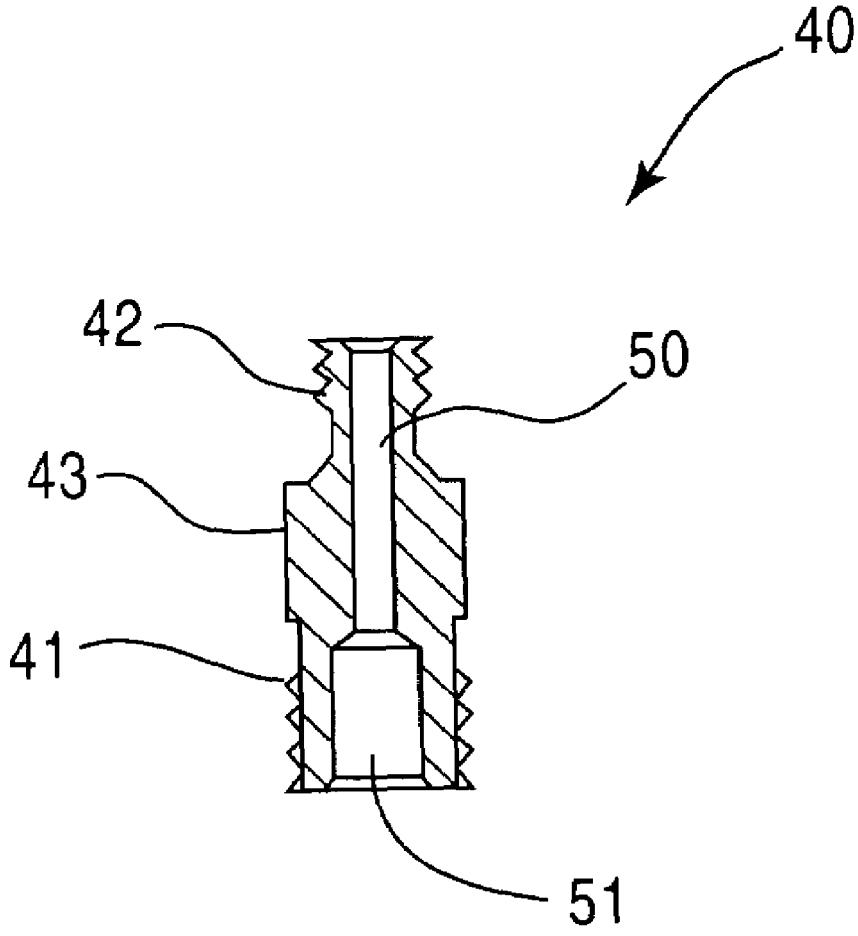
FIG. 17 is a cutaway view of the example fitting of FIG. 12, showing interior passage portions for transmitting oxygen enhancer or fuel, in accordance with an embodiment of the present invention.

FIG. 12 is a side view of an example fitting 40 for use with an injection nozzle, in accordance with an embodiment of the present invention. As shown in FIG. 12, the example fitting 40 includes a first threaded end 41 of a first diameter, a second threaded end 42 of a second diameter, and a hexagonal drivable body 43. As will be apparent to those skilled in the art, the differing diameters of threaded ends 41, 42, which are presented for illustration purposes only, are selectively variable depending on features the application involved (e.g., threaded fuel line coupling diameter). FIG. 13 shows an end view of the example fitting 40 of FIG. 12. FIGS. 14–16 present perspective views of the example fitting 40 of FIG. 12. FIG. 17 is a cutaway view of the example fitting 40 of FIG. 12, showing interior passage portions 50, 51 for transmitting oxygen enhancer or fuel, in accordance with an embodiment of the present invention.

Figure 18:
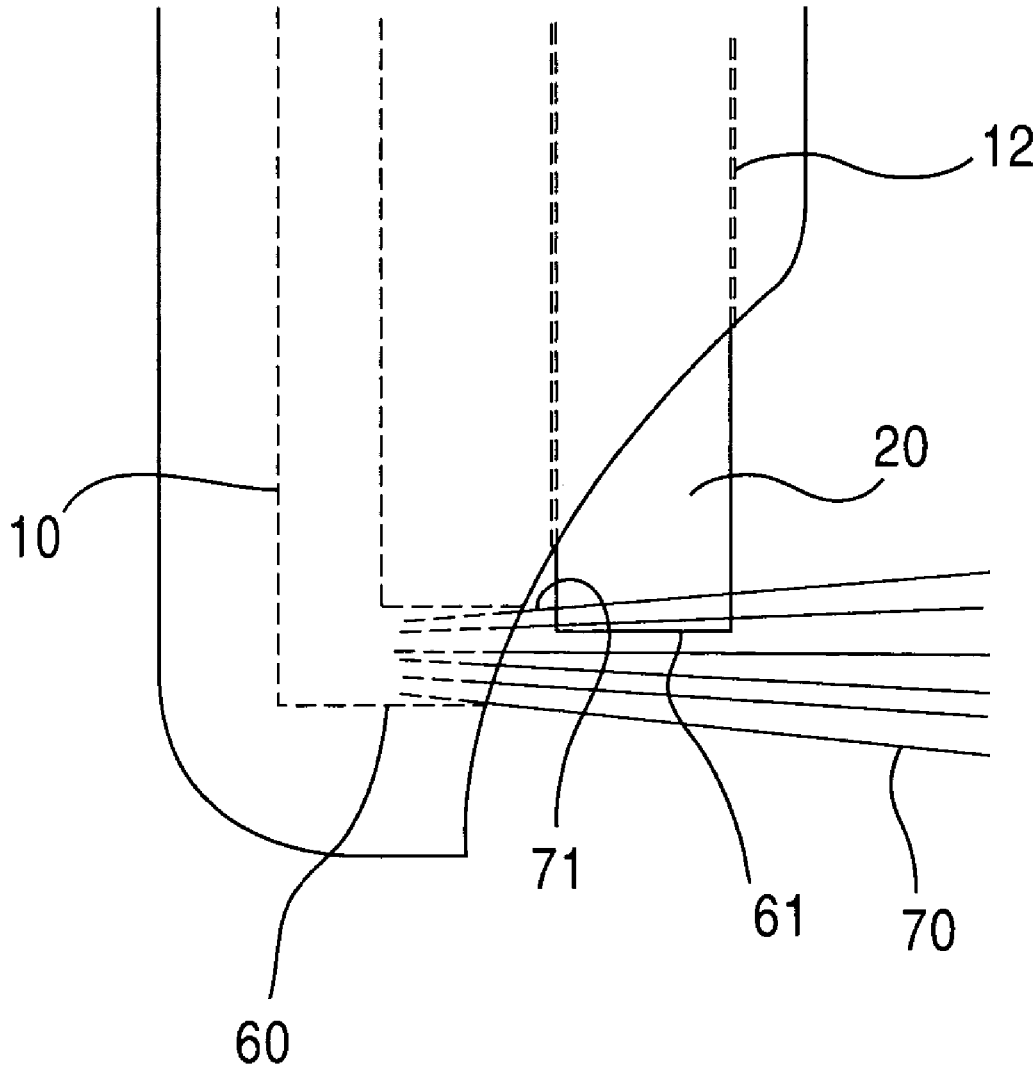
FIG. 18 is a representative diagram showing the discharge end of an injector nozzle in operation, in accordance with an embodiment of the present invention.

FIG. 18 is a representative diagram showing the discharge end 2 of an injection nozzle in operation, in accordance with an embodiment of the present invention. As shown in FIG. 18, an oxygen enhancer plume 70 is discharged via the oxygen enhancer passage 10 and a directing opening 60. The opening 60 is situated such that the plume discharged encompasses the extending end 61 of the fuel tube 20 near an edge 71 of the plume 70. Fuel discharged via the fuel passage and the fuel tube 20 is thus entrained into the plume 70, enhancing atomization of the fuel. In addition, by situating the extending end 61 of the fuel tube 20 within the plume 70 near the plume edge 71, low pressure draw of fuel via location of the plume 70 about the end 61 of the fuel tube 20 occurs, the low pressure draw varying with varying pressure of the plume 70, in turn varying, for example, with varying velocity of a transmitted flow of oxygen enhancer from a source, such as a nitrous oxide bottle.

In one embodiment of the present invention, the oxygen enhancer plume 70 is discharged via an oxygen enhancer tube fittably received (e.g., by threading) in the oxygen enhancer passage 10, the oxygen enhancer tube having the opening 60 for directably discharging the oxygen enhancer.

Figure 19:
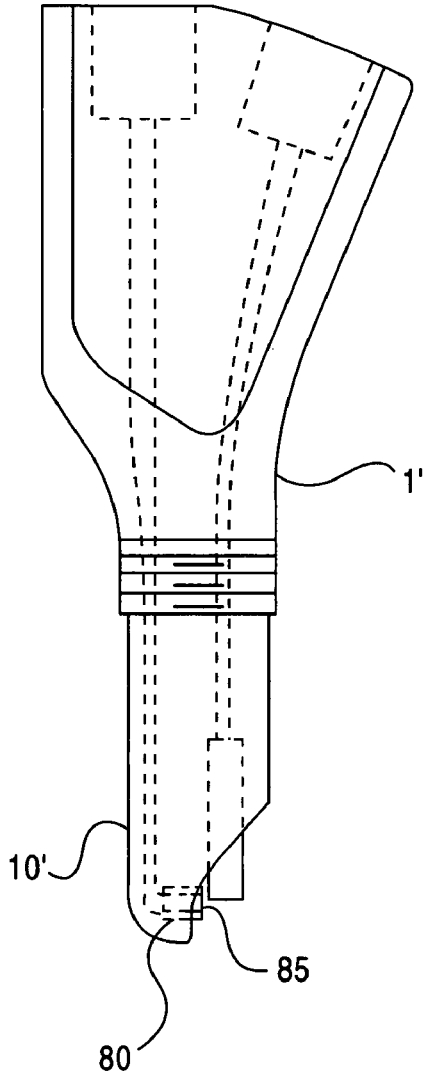
FIG. 19 is shows a cutaway view of an embodiment of the injector nozzle having a second component tube receivable in a second component passage.

FIG. 19 shows an embodiment of the injector nozzle 1'having a oxygen enhancer tube 80 receivable into an end portion of an oxygen enhancer passage 10'. 85 represents a directed opening formed in the oxygen enhancer tube 80.

Figure 20:
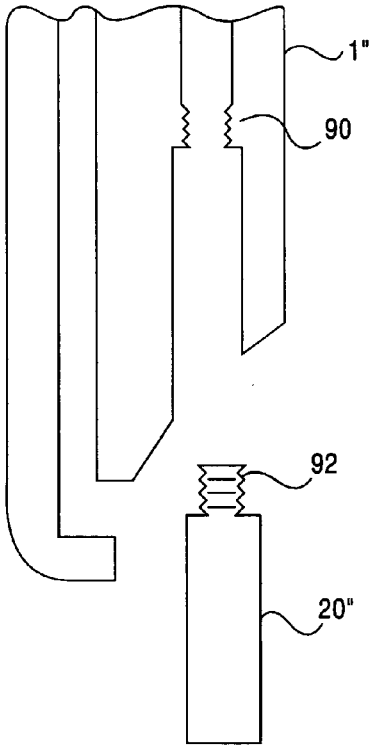
FIG. 20 is an exploded detail view of another embodiment of the injector nozzle.

FIG. 20 shows an end portion of another embodiment of the injector nozzle 1"including the interior fuel passage 11"having a threaded inner surface 90 and the fuel tube 20"having a threaded outer surface portion 92.

Figure 21:
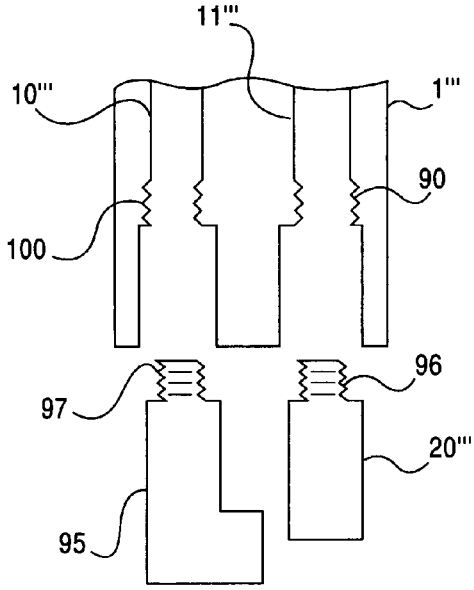
FIG. 21 is an exploded detail view of a further embodiment of the injector nozzle.

FIG. 21 shows an end portion the injector nozzle 1''', according to a further embodiment, wherein the interior fuel passage 11''' includes a threaded inner surface portion 90 and wherein the fuel tube 20''' includes a mating threaded outer surface portion 96. FIG. 21 also shows the oxygen enhancer tube 80''' having a threaded outer surface portion 97 and the oxygen enhancer passage 10''' having a mating threaded inner surface 100.

Example embodiments of the present invention have now been described in accordance with the above advantages. It will be appreciated that these examples are merely illustrative of the invention. Many variations and modifications will be apparent to those skilled in the art.

The invention claimed is:

1. A nozzle for use with an internal combustion engine for combining flows of a first component and a second component, the second component being delivered at a pressure, the nozzle comprising:

a nozzle body;

a first component passage in the nozzle body;

an output extension having an opening communicating with the first component passage, a first end of the output extension extending from the nozzle body; and a second component passage in the nozzle body, the second component passage having a directing opening that is substantially perpendicular to the first end of the output extension;

wherein a flow of the first component is discharged from the first end of the output extension, and wherein the second component passage directs a flow of the second component into the discharged flow of the first component in a direction substantially perpendicular to the flow of the first component.

2. The nozzle of claim 1, wherein the output extension includes a first component transfer tube.

3. The nozzle of claim 1, wherein the directing opening directs the flow of the second component.

4. The nozzle of claim 1, the nozzle further comprising:

a second component tube receivable in the second component passage.

5. The nozzle of claim 4, wherein the second component tube includes a directing opening, the directing opening directing the flow of the second component.

6. The nozzle of claim 5, wherein the second component passage has a threaded inner surface, wherein the second component tube has a threaded outer surface portion, and wherein the threaded outer surface portion of the second component tube is threadably matable with the threaded inner surface portion of the second component passage.

7. The nozzle of claim 1, wherein the flow of the second component forms a plume, and wherein the first end of the output extension is located in the plume of the second component.

8. The nozzle of claim 7, wherein the plume of the second component produces a low pressure draw of the first component from the output extension.

9. The nozzle of claim 8, wherein the pressure of the second component varies, and wherein the low pressure draw of the first component from the output extension varies with variation of the pressure of the second component.

10. The nozzle of claim 1, wherein the directed flow of the second component atomizes the first component in the discharged flow of the first component.

11. The nozzle of claim 1, wherein the output extension is a fuel tube.

12. The nozzle of claim 1, wherein the first component passage has a threaded inner surface portion.

13. The nozzle of claim 12, wherein the output extension has a threaded outer surface portion, the threaded outer surface portion of the output extension being threadably matable with the threaded inner surface portion of the first component passage.

14. The nozzle of claim 1, further comprising:

a first fitting attachable to the nozzle body, the first fitting having a first fitting passage.

15. The nozzle of claim 14, wherein, upon attachment of the first fitting to the nozzle, the first fitting passage communicates with the first component passage of the nozzle body.

16. The nozzle of claim 14, wherein the first fitting has a first threaded end and a second threaded end.

17. The nozzle of claim 14, wherein the first fitting has a drivable body portion.

18. The nozzle of claim 15, wherein the nozzle body has a first threaded fitting portion, and wherein the first threaded end of the first fitting is attachable to the nozzle body via the first threaded fitting portion.

19. The nozzle of claim 16, wherein the second threaded end of the first fitting is adaptable to be attachable to a threaded coupling of a fuel line.

20. The nozzle of claim 14 further comprising:

a second fitting attachable to the nozzle body.

21. The nozzle of claim 1, wherein the first component is fuel.

22. The nozzle of claim 1, wherein the second component is an oxygen enhancer.

23. The nozzle of claim 22, wherein the oxygen enhancer is nitrous oxide.

24. The nozzle of claim 1, wherein the second component is delivered from a bottle.

25. The nozzle of claim 24, wherein the pressure of delivery of the second component varies with varying bottle pressure.

26. The nozzle of claim 1, further comprising:

a threading on the exterior of the nozzle body, the threading being matable with a threading for a delivery coupling.

27. The nozzle of claim 26, wherein the delivery coupling is adaptable to couple the nozzle to a throttle body of the internal combustion engine.

28. A nozzle for use with an internal combustion engine for combining flows of a first component and a second component, the second component being delivered at a pressure, the nozzle comprising:

a nozzle body;

a first component passage in the nozzle body;

a first component transfer tube receivably located in the first component passage, a first end of the first component transfer tube extending from the nozzle body; and a second component passage in the nozzle body, the second component passage having a directing opening that is substantially perpendicular to the first end of the first component transfer tube;

wherein a flow of the first component is discharged from the first end of the first component transfer tube, wherein the second component passage directs a flow of the second component via the directing opening g in a direction substantially perpendicular to the flow of the first component, wherein the flow of the second component forms in plume, and wherein the plume encompasses the first end of the first component transfer tube.

29. A method for combining flows of a first component and a second component via a nozzle for use with an internal combustion engine, the second component being delivered at a pressure, the method comprising:

transmitting the first component via a transfer tube fittably received in a first component passage in the nozzle, a first end of the transfer tube extending from the nozzle;

transmitting the second component via a second component passage in the nozzle;

discharging a flow of the first component from the first end of the first component transfer tube; and directing a plume flow of the second component in a direction substantially perpendicular to the flow of the first component, the plume flow encompassing the first end of the transfer tube.

* * * * *